US006904760B2

(12) United States Patent
Butsch

(10) Patent No.: US 6,904,760 B2
(45) Date of Patent: Jun. 14, 2005

(54) COMPACT REFRIGERATION SYSTEM

(75) Inventor: Otto R. Butsch, Placentia, CA (US)

(73) Assignee: Crystal Investments, Inc., Christ Church (BB)

( * ) Notice: Subject to any disclaimer, the term of this patent is extended or adjusted under 35 U.S.C. 154(b) by 0 days.

(21) Appl. No.: 10/387,643

(22) Filed: Mar. 14, 2003

(65) Prior Publication Data

US 2003/0172662 A1 Sep. 18, 2003

Related U.S. Application Data

(63) Continuation of application No. 09/871,741, filed on Jun. 4, 2001, now abandoned, which is a continuation of application No. 09/385,452, filed on Aug. 30, 1999, now abandoned.

(60) Provisional application No. 60/113,943, filed on Dec. 23, 1998.

(51) Int. Cl.[7] ..... F25B 1/02; F25B 41/00

(52) U.S. Cl. ..... 62/115; 62/174; 62/204; 62/498

(58) Field of Search ..... 62/115, 118, 119, 62/174, 324.6, 498, 503, 509, DIG. 2, 203, 204, 205, 206; 165/104.24, 104.25

(56) References Cited

U.S. PATENT DOCUMENTS

| | | | |
|---|---|---|---|
| 258,227 | A | 5/1882 | Gergens |
| 2,009,373 | A | 7/1935 | Moore |
| 2,226,797 | A | 12/1940 | Andersson |
| 2,836,965 | A | 6/1958 | Kleist |
| 2,904,969 | A | 9/1959 | Reamer |
| 3,226,941 | A | 1/1966 | Snelling |
| 3,572,980 | A | 3/1971 | Hollyday |
| 3,698,182 | A | 10/1972 | Knöös |
| 3,757,532 | A | 9/1973 | Brandt |
| 3,800,550 | A | 4/1974 | Delahunty |
| 3,922,877 | A | 12/1975 | Ophir et al. |
| 4,169,361 | A | 10/1979 | Baldus |

(Continued)

*Primary Examiner*—Harry B. Tanner
(74) *Attorney, Agent, or Firm*—Cesari and McKenna, LLP; William A. Loginov

(57) ABSTRACT

A selectively controllable valve is arranged in a refrigeration circuit which interconnects the evaporator and the condenser and is controlled so that a pressure differential is built up across the valve. The valve is selectively opened to allow "batches" of working fluid to pass therethrough. In some embodiments, the working fluid which is allowed to pass through the valve, is heated in a chamber to increase the amount of pressure on the downstream side of the valve. This produces expanded pressurized working fluid which increases the pressure in the condenser and forces previously condensed and liquefied working fluid through a flow restricting transfer device into an evaporator. Condensation of the just heated gas in the condenser subsequently reduces the pressure on the downstream side of the valve and establishes conditions suitable for the passage of a further amount of gaseous working fluid while itself becoming liquid to be forced through the flow restricting transfer device. Quick repetition of these cycles establishes a dynamic flow conditions and maintains the flow of liquefied working fluid into the evaporator. In other embodiments, the pressure differential is produced and/or augmented by pump such as a piston pump, or a combination of the pump and the heating chamber. If sufficient condensation can be induced using the operation of the condenser or by some other means and the required pressure differential developed, then both the heater and the pump can, depending on the circumstances and the cooling capacity that is required, be omitted. The flow of liquid working fluid from the condenser is transferred to the evaporator via either a capillary tube or a selectively controllable valve arrangement which can also posses pumping characteristics if so desired.

16 Claims, 6 Drawing Sheets

U.S. PATENT DOCUMENTS 4,250,721 A 2/1981 Wilmers et al.
4,345,440 A 8/1982 Allen et al.
4,378,681 A 4/1983 Modisette
4,598,687 A 7/1986 Hayashi
4,604,036 A 8/1986 Sutou et al.
4,625,522 A 12/1986 Cheron et al.
4,697,427 A 10/1987 Niggemann et al.
4,765,148 A 8/1988 Ohashi
4,798,057 A 1/1989 Okamoto et al.
4,824,454 A 4/1989 Kondo et al.
4,866,947 A 9/1989 Webster
4,972,678 A 11/1990 Finlayson
5,216,899 A 6/1993 Fabris
RE35,235 E 5/1996 Beckerman
5,533,338 A 7/1996 Lee et al.
5,647,221 A 7/1997 Garris et al.
5,689,959 A 11/1997 Yatsuzuka et al.

COMPACT REFRIGERATION SYSTEM

This application is a continuation of application Ser. No. 09/871,741, filed Jun. 4 2001, now abandoned, which is a continuation of application Ser. No. 09/385,452, filed Aug. 30, 1999, now abandoned, which claims priority from Provisional application Ser. No. 60/113,943, filed Dec. 23, 1998.

CROSS-REFERENCE TO RELATED APPLICATIONS

This application claims priority from provisional patent application Ser. No. 60/113,943 filed on Dec. 23, 1998, entitled COMPACT REFRIGERATION SYSTEM which is incorporated herein by reference thereto.

BACKGROUND OF THE INVENTION

1. Field of the Invention

The present invention relates generally to a small lightweight refrigeration system and more specifically to such a system which dynamically controls the flow of working fluid within the system in a manner which enables the unit to be rendered both light weight and highly compact.

2. Related Art

In order to render refrigeration units small and compact efforts have been directed to rendering the pump, which is used to compress and drive the working fluid through the system, small, compact and quiet. However, these arrangements have not met with the full success in that they inevitably rely on rotating type pumps or compressors and tend to become quite complex and therefore expensive. One example of a compact device which uses pistons to achieve cooling, although it is directed to a very special type of cryogenic application, is found in U.S. Pat. No. 4,858,442 issued on Aug. 22, 1989 in the name of Stetson.

However, irrespective of such developments, still problems remain in the type of refrigeration system which is incorporated into air conditioning units such as those used in automotive vehicles. For example, in such arrangements, the compressor is invariably driven by the output of the prime mover, viz., the engine, and is therefore located in the engine compartment close to the engine to enable the appropriate drive connection (usually a belt drive) to be established. This disposition, along with the need to have other pieces of apparatus such as the condenser located close the compressor and disposed in similar locations, leads to a number of drawbacks.

More specifically, the fact that the compressor is driven by a mechanical connection with the engine demands that its rotational speed will vary and thus requires that the air-conditioning system be provided with an accumulator or some form of compensation arrangement, in order to compensate for the fluctuations in the amount of refrigerant which is discharged by the compressor. Furthermore, the fact that the compressor tends to be disposed in a heated environment (viz., in a hot engine compartment and close to an even hotter engine) exposes the coolant to additional heating which demands the use of thick, robust and expensive thermally insulated hoses, and also requires that the condenser be located at some distance from the compressor so as to escape the heat radiation to much as possible and to be exposed to a flow of cool air. However, the conduiting which is associated with the condenser usually must pass through the engine room or close thereto, on its way to the evaporator, and therefore must also be thermally insulated in order prevent it from becoming excessively reheated.

Furthermore, a considerable length of conduiting is involved which, in combination with the need to provide the above mentioned accumulator, causes the total amount of working fluid which is required, to increase. The pumping loads involved in pushing the refrigerant (i.e., the working fluid) through the long conduits in addition to the weight of the materials and apparatus involved, leads to a situation wherein automotive air conditioning systems are inevitably heavier, more complex, more expensive and less efficient than desired.

In high performance vehicles, wherein the distribution of heavy/bulky elements such as the compressor and the condenser is becoming ever more important due to the use of advanced/expensive materials which allow the weight of various components of the vehicle/engine to be reduced, the need to have the compressor, etc, disposed in the highly cramped engine compartment, becomes even a greater problem. Not only is the weight distribution rendered more difficult, but the presence of such devices tends to reduce the ability to add further equipment such as a second turbocharger or intercooler.

To make matters worse, with the approach of electrically powered vehicles, which use fuel cells and or hybrid generation systems, the availability of a powerful prime mover such as the internal combustion engines which are in current use, will vanish and the need for lighter, more power efficient arrangements will increase exponentially.

Thus, as will be appreciated, there is a need for a light, power economical refrigerating arrangement which can overcome the above mentioned types of drawbacks as well as provide a quite and compact arrangement which can be conveniently located as needed.

SUMMARY OF THE INVENTION

It is therefore proposed to provide a small, compact refrigeration unit/arrangement which can be used in various applications, which is, by its nature, quiet and such that it can be readily arranged in locations wherein the amount of space is small.

It is also proposed to provide a method of controlling a refrigerating arrangement which allows the device to be light, compact and quiet.

In brief, these aims are achieved by an arrangement wherein a selectively controllable flow control valve is arranged in a refrigeration circuit conduit which interconnects the evaporator and the condenser and is controlled so that a pressure differential is permitted to build up across the valve. This flow control valve can take the form of an on/off type valve, a flow restriction valve which is able to throttle flow between full open and almost closed, or a one-way valve/flow control arrangement, and is rapidly opened/closed to allow "batches" of working fluid to pass therethrough. In some embodiments, the working fluid which is allowed to pass through the valve, is heated in a chamber to increase the amount of pressure on the downstream side of the valve. This produces expanded pressurized working fluid which increases the pressure in the condenser and forces previously condensed and liquefied working fluid through a flow restricting transfer device into an evaporator. Condensation of the just heated gas in the condenser subsequently reduces the pressure on the downstream side of the valve and establishes conditions suitable for the passage of a further amount of gaseous working fluid while itself becoming liquid to be forced through the flow restricting transfer device. Quick repetition of these cycles establishes a dynamic flow conditions and maintains the flow of liquefied working fluid into the evaporator.

In other embodiments, the flow of gaseous working fluid through the flow control valve can be augmented by pump such as a solenoid piston pump, and can be combined with a heating chamber. Nevertheless, if sufficient condensation can be induced using the operation of the condenser or by some other means, then both the heater and the pump can, depending on the circumstances and the cooling capacity that is required, be omitted. The flow of liquefied working fluid from the condenser is transferred to the evaporator via either a capillary tube or a selectively controllable valve arrangement which can also posses pumping characteristics if so desired.

More specifically, a first aspect of the invention resides in a refrigerating arrangement having a condenser and an evaporator which are fluidly connected by a working fluid transfer device and wherein a pressure differential is produced across the fluid transfer device which induces liquefied working fluid to flow from the condenser to the evaporator. This pressure differential is controlled by a rapidly opened/closed flow control device/valve that is disposed between the downstream end of the evaporator and the upstream end of the condenser for selectively interrupting the flow of working fluid therebetween in a timed relationship with the rate of condensation of working fluid in the condenser so as to maintain a pressure differential across the working fluid transfer device to force liquefied working fluid into the evaporator.

In accordance with the above aspect of the invention, a controller, which is responsive to a sensor arrangement, is used for selectively controlling the flow control device and for controlling the timing of the flow interruption so as to occur a plurality of times per second. To achieve this control at least one of a first pressure sensor disposed upstream of the flow control device, and a second pressure sensor is disposed downstream thereof.

The above arrangement can also include a heating chamber which is disposed downstream of the flow control device and operatively connected with the controller to heat and expand the gaseous working fluid which has been permitted to pass through the flow control device. To facilitate this heating control, a temperature sensor which is associated with the heating chamber, is used for detecting the temperature of the gaseous working fluid which is heated and expanded in the chamber.

In addition to the above, a pump can be disposed upstream of the flow control device and operatively connected with the controller so as to operate in a timed relationship with the opening of the flow control device. Further, the working fluid transfer device which fluidly connects the condenser and the evaporator, can take the form of a simple capillary tube. Alternatively, this working fluid transfer device can take the form of a selectively operable valve having a variable orifice for throttling the amount of liquefied working fluid which is permitted to be released into the evaporator.

A dryer can be interposed between the condenser and the working fluid transfer device for removing predetermined types of contaminants from the working fluid. The fluid transfer device can alternatively take the form of a pump which is adapted to selectively pump liquefied working fluid therethrough in a timed relationship with the opening of the flow control device.

A second aspect of the invention resides in a method of operating a refrigeration unit having a condenser and an evaporator which are fluidly connected by a working fluid transfer device and wherein a pressure differential is produced in a manner which induces working fluid to flow from the evaporator to the condenser.

The method features the step of selectively interrupting the flow of working fluid from the downstream end of the evaporator to the upstream end of the condenser using a selectively operable flow control device which is operatively disposed between the downstream end of the evaporator and the upstream end of the condenser so as to maintain a pressure differential across the working fluid transfer device to force liquefied working fluid through the working fluid transfer device into the evaporator.

The above method can further include the step of controlling the operation of the flow control device using a controller which is responsive at least one sensed parameter. Additionally, the method can feature the step of heating a portion of the working fluid, which has passed through the flow control device, to expand the gaseous working fluid and to increase the pressure on the downstream side of the flow control device. This elevated pressure is used to drive liquefied working fluid from the condenser through the transfer device to the evaporator.

Yet moreover, the method can include the step of sensing the temperature of the working fluid which is heated and supplying an indication of the sensed temperature to the controller. Further, the step of heating is carried out under the control of the controller and can be effected in a timed relationship with the opening of the flow control device and the delivery of a volume of the gaseous working fluid into a heating chamber which is located downstream of the flow control device.

In addition to the above, the method can also include the step of pumping working fluid toward the flow control device using a pump which is disposed upstream of the flow control device in a predetermined timed relationship with the opening of the flow control device. Further, the method features sensing pressure at a location downstream of the flow control device; and controlling the operation of the flow control device in accordance with the pressure which is sensed at the downstream position. Alternatively, or in addition to the above, the method can include steps of: sensing pressure at a location which is upstream of the flow control device; and controlling the operation of the flow control device in accordance with the pressure which is sensed at the upstream position.

A third aspect of the invention resides in a method of operating a refrigeration unit comprising the steps of: condensing the working fluid vapor back to a liquid form via a first heat exchange on a downstream side of a flow control device; passing the liquid working fluid through a flow restricting transfer device and expanding the condensed liquid in a manner in which heat is absorbed via a second heat exchange; recycling the gaseous working fluid back to the flow control device; and timing the opening/closing of the flow control device to permit a quantity of working fluid to pass therethrough in accordance with a pressure differential which prevails thereacross and in a manner which simultaneously maintains the necessary pressure differential to force the liquid working fluid through the transfer device.

A fourth aspect resides in a refrigeration unit comprising: means for condensing a working fluid vapor back to a liquid form via a first heat exchange on a downstream side of a flow control device/valve to momentarily reduce the working fluid pressure on the downstream side of the flow control device; means for expanding the condensed liquid working fluid via which has passed through a flow restriction device in a manner in which heat is absorbed via a second heat exchange; recycling the working fluid back to the flow control device; and means for timing the opening/closing of the flow control device to permit a quantity of working fluid to pass therethrough in accordance with the reduced pressure which prevails on the downstream side of the flow control device.

Another aspect of the invention resides in a refrigeration system having a closed loop including a condenser, an evaporator and a transfer device via which liquefied working fluid is transferred from the condenser to the evaporator, comprising: a pressure differential generator comprising a heating chamber or pump via which a pressure differential in the loop is augmented to move the liquefied working fluid toward the evaporator; a control parameter sensor associated with the pressure differential generator for sensing a parameter which is indicative of the magnitude of the pressure differential which tends to move the liquefied working fluid toward the evaporator; and a flow control device which is arranged with the pressure differential generator so that it selectively permits discrete amounts of gaseous working fluid to flow therethrough in the direction of the condenser, the flow control device being controlled in accordance with the output of the control parameter sensor.

Yet another aspect of the invention resides in a method of operating a refrigeration unit comprising the steps of: transferring heat to an amount of a working fluid in a chamber or conduit to expand and pressurize the already gaseous working fluid; condensing the expanded working fluid to a liquid in a condenser; introducing a further amount of working fluid into the chamber when the pressure in the chamber has lowered due to the condensation of the working fluid vapor in the condenser; transferring liquid working fluid from the condenser to an evaporator via a flow control device; recycling working fluid to the chamber via a flow control arrangement and introducing a further amount of working fluid into the chamber when the pressure in the chamber has lowered due to the condensation of the working fluid vapor in the condenser; and repeating the repeating the steps of heating, condensing, transferring and recycling.

In accordance with this aspect the method can further include the step of pumping working fluid from the evaporator toward the flow control arrangement.

Another aspect of the invention resides in a refrigeration system having: a condenser, an evaporator, a transfer device via which working fluid is transferred from the condenser to the evaporator, a flow control device which permits amounts of working fluid from the evaporator to pass therethrough in spaced discrete intervals toward the condenser, and a pump which is located either upstream or downstream of the flow control device. This pump features: a reciprocal pump element; a linear acting motor operatively connected with the pump element; a control circuit operatively connected with the linear acting motor for controlling the linear drive force which is applied to the pump element and the manner in which working fluid which is displaced by pump, the control circuit being responsive to one or more sensors which determine a control parameter such as pressure differential across the flow control device.

In accordance with this method the flow control device is operatively connected with the control circuit so that it is opened and closed in a timed relationship with reciprocation of the pump element in a manner wherein columns of working fluid can be what shall be referred to herein as "inertia rammed" through the flow control device.

BRIEF DESCRIPTION OF THE DRAWINGS

The various features and advantages of the present invention will become more clearly appreciated from the following detailed description of the embodiments taken with the appended drawings in which.

DETAILED DESCRIPTION OF THE PREFERRED EMBODIMENTS

Figure 1:
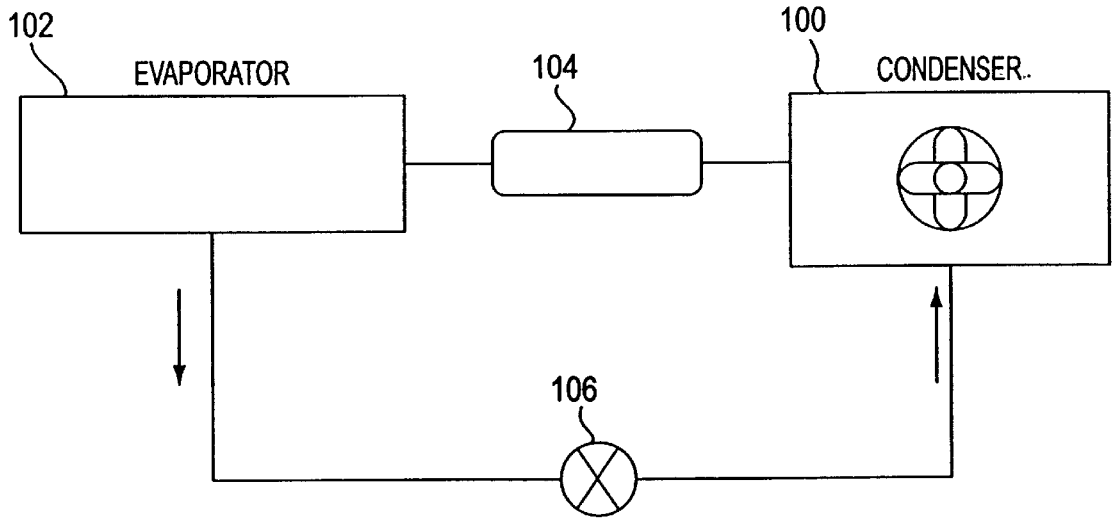
FIG. 1 is a schematic diagram showing an arrangement which demonstrates the essence of the concept on which the present invention is based.

FIG. 1 schematically shows a conceptual arrangement of the present invention. This arrangement, as shown, includes a condenser 100, an evaporator 102, a fluid transfer device 104 which controls the transfer of liquid working fluid from the condenser to the evaporator, and a flow control valve 106 which is interposed between the downstream end of the evaporator 102 and the upstream end of the condenser 100. As will be appreciated, this figure is provided to illustrate the basic simplicity of the invention.

If a pressure differential can be temporarily established across the flow control valve 106, the working fluid (gaseous refrigerant) will flow toward the condenser 100 when the valve 106 is open. In fact, if sufficient heat can be removed from the working fluid at the condenser 100 and/or sufficient heat be transferred to the fluid in the evaporator 102, and the flow control valve 106 is controlled with an appropriate timing and remains closed for periods just long enough for the condensation of the working fluid which is taking place in the condenser 100, to lower the pressure on the downstream side of the valve, then it is possible to intermittently "batch" the fluid flow therethrough while maintaining an effective pressure differential across the liquefied working fluid which is being transferred to the evaporator 102, via the fluid transfer device 104, and thus ensure that the liquefied working fluid is forced toward the evaporator 102 in the manner necessary to produce the required refrigeration effect.

The timing with which the batches of fluid are permitted to pass through the valve 106 is very important in order to induce dynamic movement of gaseous working fluid between the downstream end of the evaporator 102 and the upstream end of the condenser 100, and to achieve an intermittent raising and lowering of pressure which is supplied to the condenser 100.

Experiments have shown that if the valve 106 is operated with a duty cycle wherein the valve is open for 50 ms and closed for 50 ms, and wherein a peak pressure of about 115 psi is periodically developed downstream of the valve 106 while a pressure of about 25 psi prevails on the upstream side, then effective cooling is possible. It will of course be understood that these values/pressures are merely exemplary and that considerable variation is within the scope of the invention.

In this illustrated arrangement, the flow control device 104 can take the form of a capillary tube which transfers the liquid working fluid from the condenser 100 and induces the same to flash as it is supplied to the evaporator 102. It can also take the form of a selectively controlled valve (see FIG. 7 for example) which is able to provide a variable orifice via which the working fluid can be delivered to the evaporator. This type of valve also permits an increase in the timing of the flow of fluid within the closed loop circuit which interconnects the functional elements of the system. Further disclosure of this type of valve will be given in more detail hereinlater.

The condenser 100 and the evaporator 102 can take various forms some of which are well known and commercially available. However, the invention is not limited to any particular arrangement and it is within the scope of the invention to utilize a large variety of devices/arrangements.

As made clear above, with the present invention it important that "intelligent" control be exercised over the opening and closing of the flow control valve in order to achieve the required flow dynamics. To this end, as shown in FIG. 2, a control circuit or arrangement generally denoted by the numeral 108, is operatively connected with the valve 106 and arranged to be responsive to a suitable sensor or sensors (generally denoted by the numeral 110) which sense parameters which are indicative of the operation of the refrigerating arrangement.

With the provision of this control circuit or arrangement 108, it is possible to control the timing with which the valve 106 is opened and closed in a manner which permits the operation of the system to be optimized. For example, if an excessive pressure reduction tends to occur at the condenser 100 due to excessive cooling and condensing of the working fluid therein, then the flow of liquid working fluid to the evaporator may be detrimentally effected.

Accordingly, it is advantageous to monitor the pressure or a parameter indicative thereof, and to open the valve 106 with the optimum dynamic control inducing timing. However, it should be understood that both the frequency of valve operation along with and the periods for which the valve is open and that for which it is closed can be varied to efficiently "batch" the delivery of the working fluid through the control valve 106 to either maximize the efficiency of the system or to reduce the same in the event that a reduction in the amount of cooling which is occurring, needs to be implemented.

Figure 2:
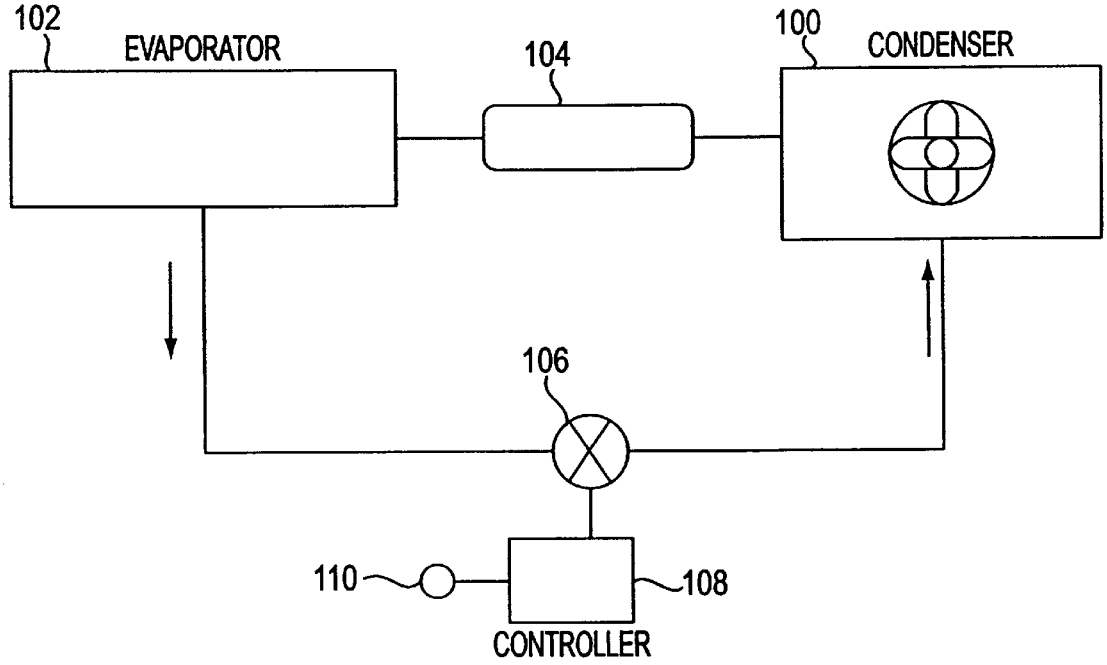
FIG. 2 is a schematic diagram depicting an embodiment wherein a flow control device/valve which forms a vital part of the invention is controlled in response to a sensed parameter or parameters.
Figure 3:
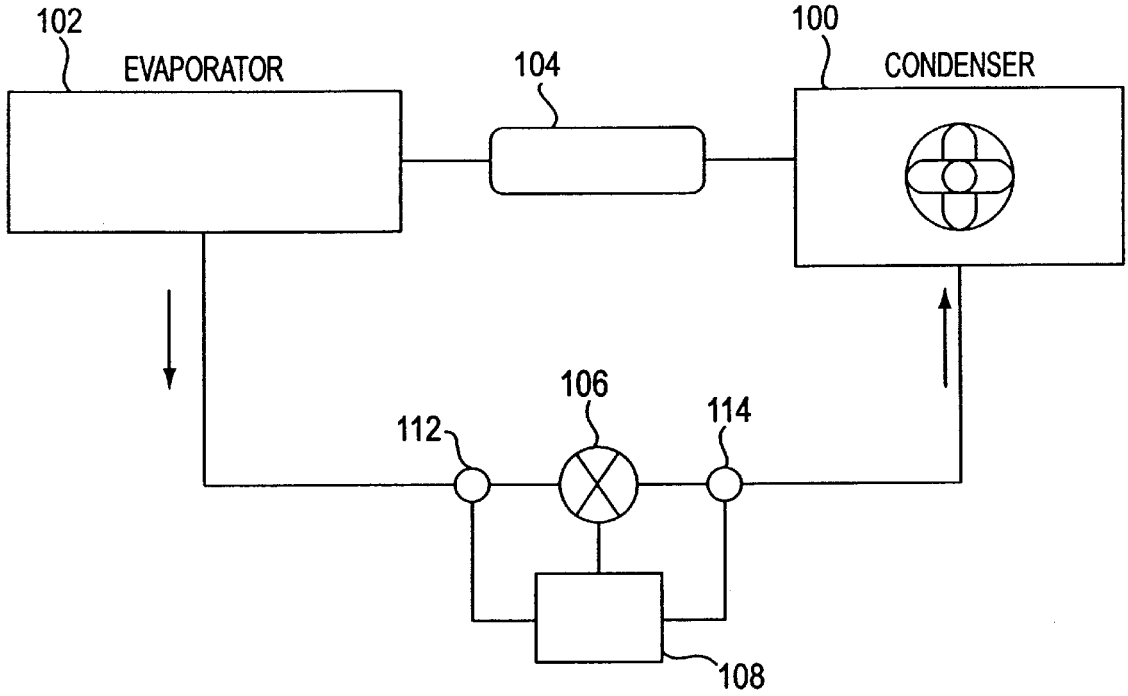
FIG. 3 is a schematic diagram showing an embodiment which uses two pressure sensors to provide control data for the flow control valve.

It must be appreciated of course that, what is disclosed in FIGS. 1 and 2 is highly schematic and is merely relied upon to show the basic concept of the flow control which forms an important part of the present invention. In fact, while FIG. 3 shows the use of two pressure sensors 112, 114, it is within the scope of the present invention to use other types of sensors such as temperature sensors or the like, which can be used to sense a parameter which varies with pressure and which can be relied upon to provide an accurate indication of the pressure differential which has developed across the flow control valve 106. The flow control valve 106 in this and other embodiments can in fact take the form of an automotive fuel injector.

Figure 4:
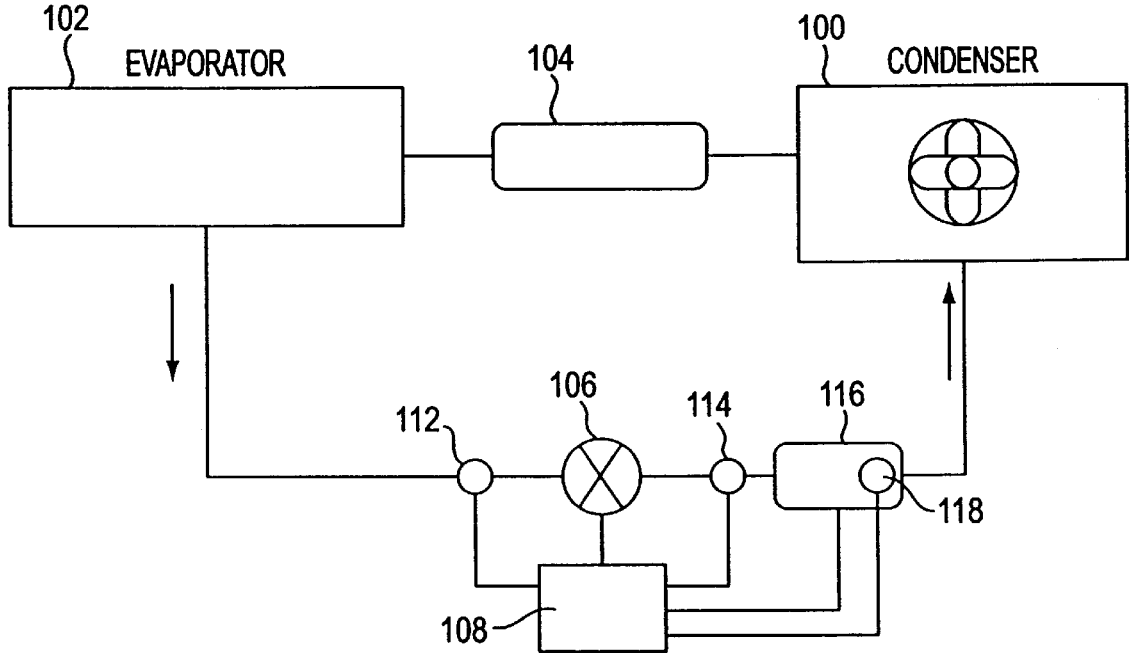
FIG. 4 is a schematic diagram similar to those shown in FIGS. 1–3, showing an embodiment wherein a heating chamber is provided in order to increase the pressure of the working fluid vapor which is supplied to the condenser.

FIG. 4 shows an embodiment wherein a heating chamber 116 is provided downstream of the flow control valve 106 for receiving the discrete volume (or batch) of gaseous working fluid which has been passed therethrough. The operation this heating chamber 116 is placed under control of the controller 108 (as it will be referred to hereinafter). A temperature sensor 118 is disposed in the chamber or immediately downstream thereof, so as to monitor the temperature to which the fluid in the chamber 116 is elevated.

The heating of the working fluid in the heating chamber 116 produces expansion and an increase in the pressure prevailing in the chamber 116 and therefore the condenser 100. As the gas condenses in the condenser and assumes liquid form, the pressure in the chamber 116 and the condenser 100, lower. At this time it is necessary to batch another volume of working fluid into the heating chamber 116 and repeat the heating and pressure developing expansion process with the minimum of delay. This process can be, in part, likened to the operation of a pulse jet type rocket engine.

It will however, be noted that the use of this temperature sensor 118 can be omitted if so desired and the output of the pressure sensor 114 which is disposed upstream of the chamber, can be relied upon to provide an indication of the pressure boost which has been achieved via the heating and expansion of the working fluid within the chamber 116. It will also be noted that the use of a chamber per se is not required and that a length of the conduit which leads to the condenser 100 and which is exposed to a suitable source of heat, can be used to achieve the necessary heating.

Figure 5:
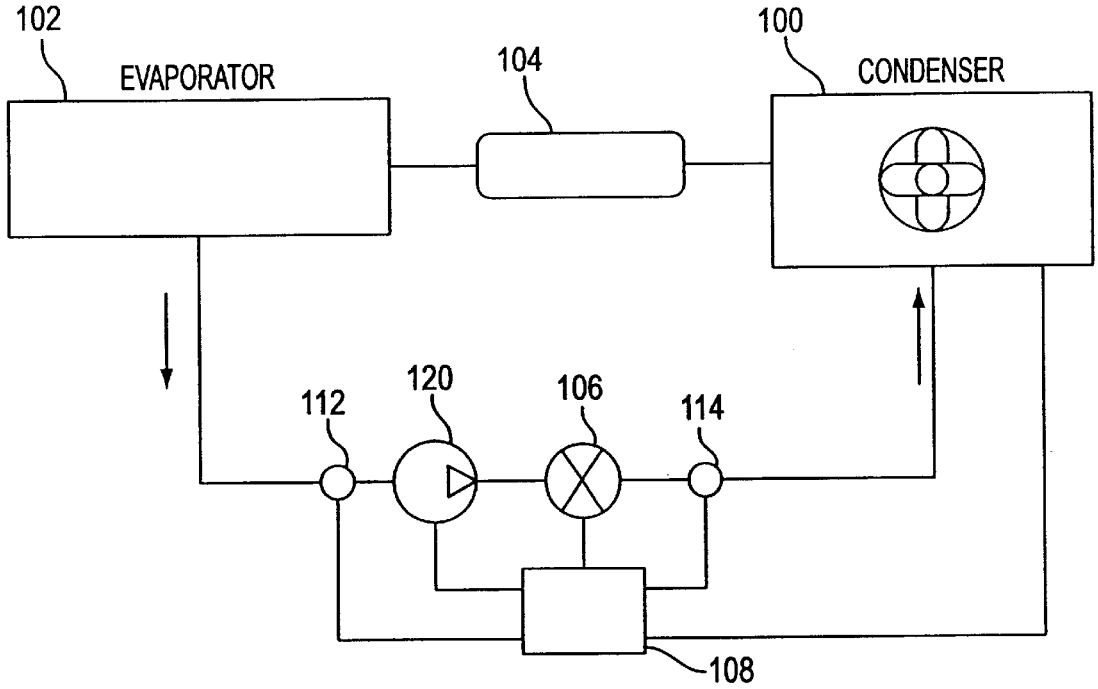
FIG. 5 is a schematic diagram similar to that shown in FIG. 4 showing an embodiment wherein a pump is used in place of the heating chamber.

FIG. 5 shows an embodiment wherein the heating chamber 116 is omitted and a pump 120 is introduced into the circuit at a location which is upstream of the flow control valve 106. In this instance, the pump 120 can be of any suitable type, however, is advantageously controlled by the controller 108 so as to avoid wasteful and/or untimely operation. Nevertheless, it is within the scope of the invention to use a continuously operated type.

The pump 120 is located so that working fluid which is returning from the evaporator can be pressurized in a timely manner and in preparation of the opening of the flow control valve 106. An example of a pump which is deemed advantageous for use as this element will be discussed in more detail hereinlater with reference to FIGS. 9 and 10.

Figure 6:
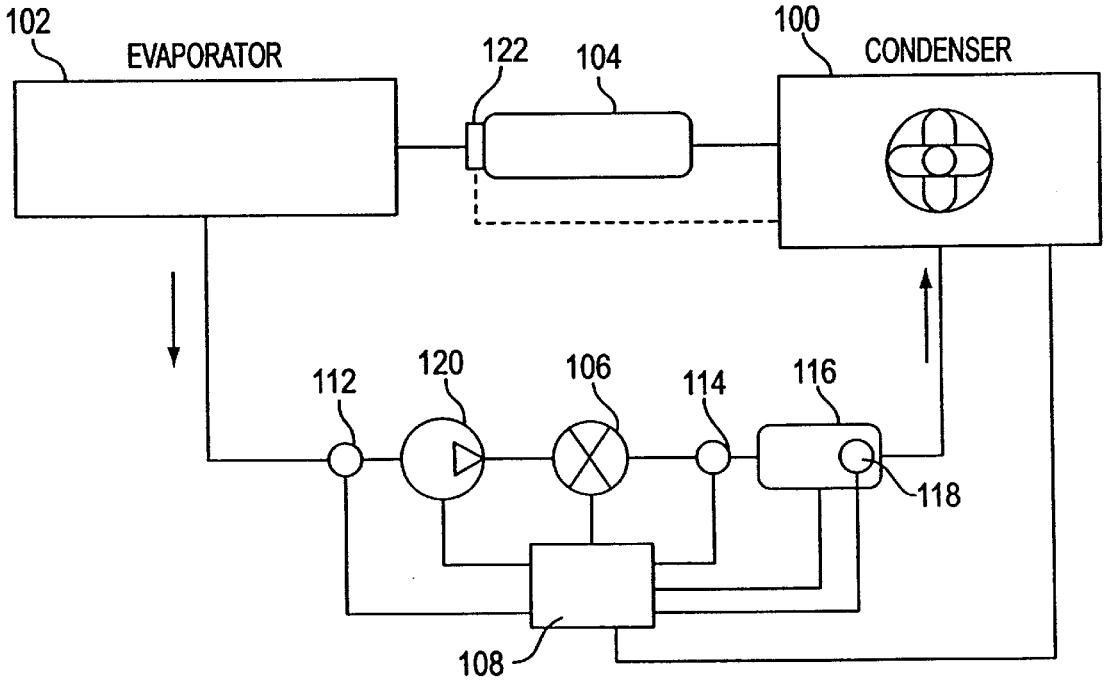
FIG. 6 is a schematic diagram showing an embodiment wherein the circuit is provided with a both a pump and a heating chamber.

FIG. 6 shows an embodiment wherein the pump 120 and the heating chamber 116 are used in combination. With this tandem arrangement, the pressure which can developed on the downstream side of the flow control valve 106 is increased while the back pressure which may tend to develop downstream of the evaporator 102 is reduced the provision of the pump 120.

In this figure, a "defrosting" heater 122 is shown provided at the downstream end of the flow control device 104. In this embodiment, as well as those which are shown in FIGS. 1–5, it can be assumed that this device takes the form of a capillary tube. The so called "defrosting heater" 122 is provided to ensure that the flashing of the working fluid which occurs, does not freeze up the downstream end of the device and maintains the same at maximum working efficiency. As illustrated in dotted line, it is possible for this heater to be supplied with waste heat from the condenser. This connection can take the form of supplying a portion of the hot air which is released into the ambient atmosphere, a heat pipe which conducts heat from the condenser using its own working fluid, or the like. The end of the flow control device 104 can even be located in or beside the condenser so as to be suitably exposed to heat radiation if so preferred.

It will be understood of course that this defrosting device can be provided on all of the embodiments which are disclosed in connection with the present invention, and is not limited to this particular instance.

Figure 7:
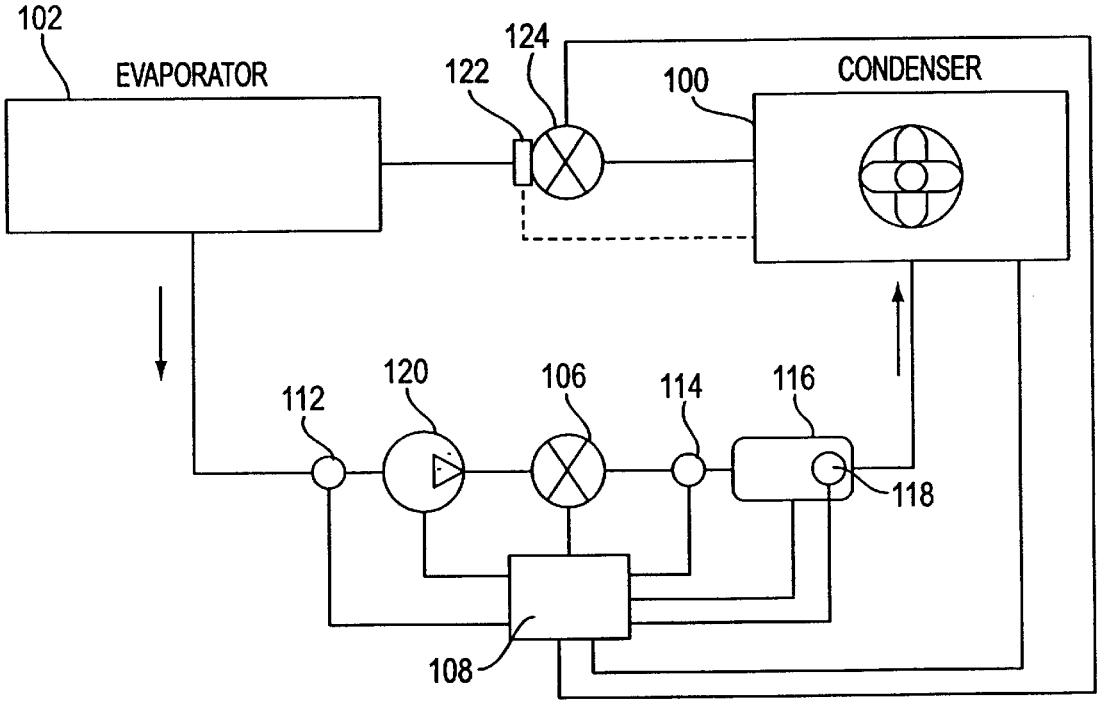
FIG. 7 is a schematic diagram showing an embodiment wherein a capillary tube is replaced with a selectively controllable valve.

FIG. 7 shows an embodiment of the invention which is basically similar to that shown in FIG. 6, and differs in that the capillary tube arrangement is replaced with a selectively controllable valve 124. In light of the fact that this valve 124 will have a movable valve element, and thus be able to vary the orifice through which the working fluid is able to flow to the evaporator, the provision of the defrosting heater 122 at the downstream end thereof is deemed particularly advantageous in order to prevent potential sticking of the same.

Figure 8:
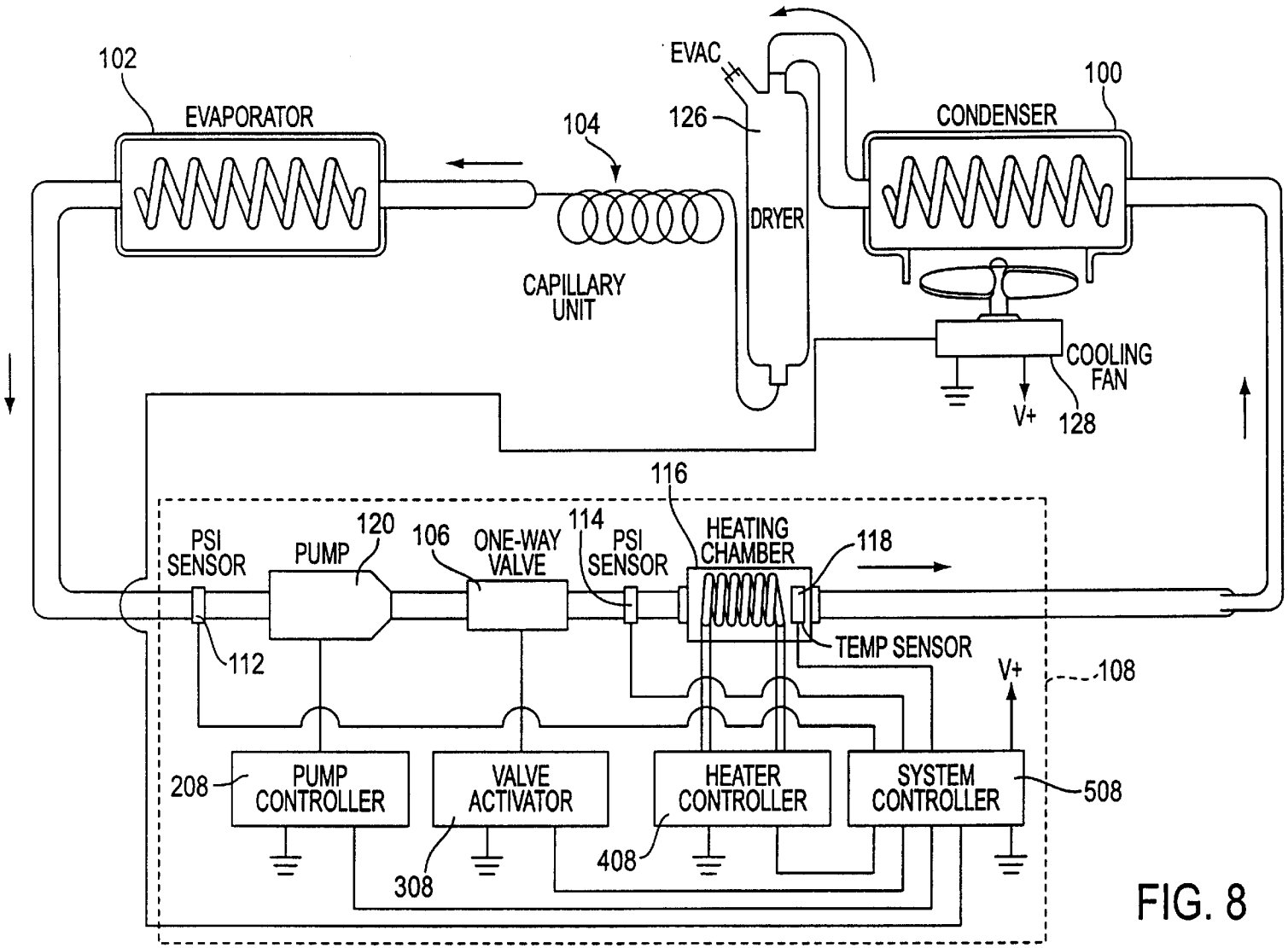
FIG. 8 is a more detailed diagram showing the embodiment which is schematically depicted in FIG. 6.

FIG. 8 shows a more detailed arrangement of the type of arrangement which is depicted in FIG. 6. As will be noted, this arrangement includes a dryer 126 which interposed between the condenser 100 and the capillary tube 104. This device removes contaminants from the working fluid and ensures that the operation of the system is not impaired by the presence of the same. The remaining construction is essentially self-evident. The controller 108, in this arrangement is depicted as being divided into a pump controller 208, a valve actuator 308, a heat controller 408, and an overall system controller 508.

In this embodiment, the condenser 100 is shown as being an air cooled arrangement wherein a fan 128 is used to drive a draft of cooling air over the heat changing coils into which the pressurized working fluid vapor from the heating chamber, is delivered. The operation of the fan 128 is, as shown, controlled by the system controller 508.

The present invention is, however, not limited to the use of air cooled condensers and the use of water and/or air/water type condensers can be envisaged. For example, if a source of cold/ambient temperature running water is available then it is within the scope of the present invention to use the same to remove heat from the working fluid which is passing through the condenser portion of the circuit.

Figure 9:
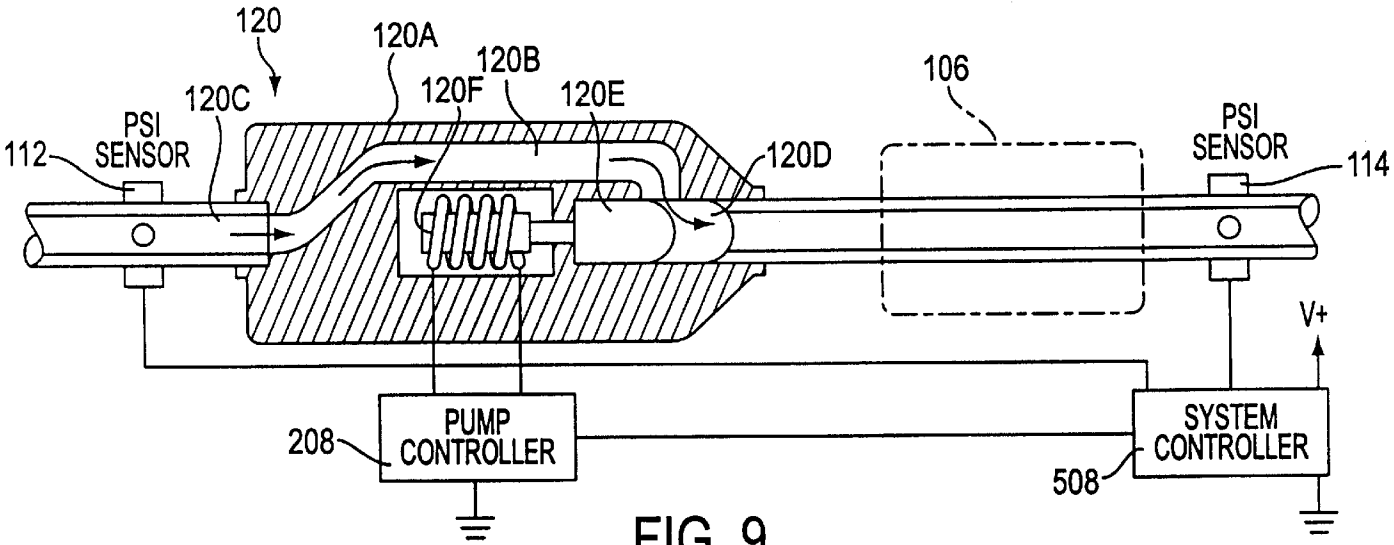
FIGS. 9 and 10 are diagrams which shown details of a solenoid powered piston pump which can find application with the embodiments of the invention which are shown in FIGS. 5–7 for example.
Figure 10:
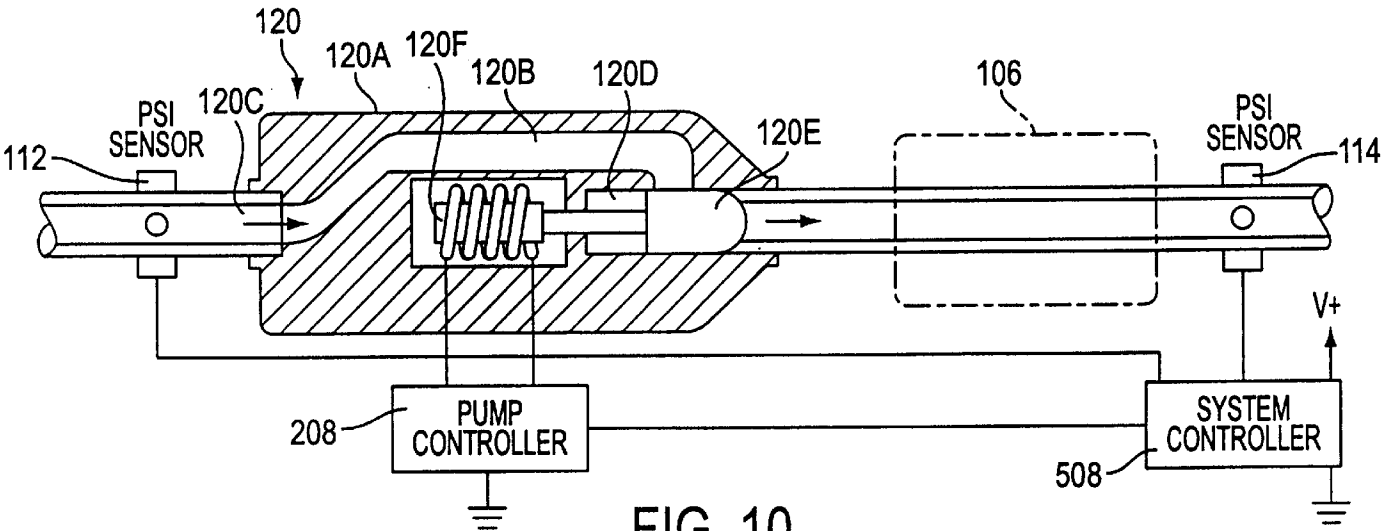

FIGS. 9 and 10 show details of a pump which can be used as the pump 120 of the embodiments of the invention. This pump consists of a housing 120A in which a coolant channel 120B is formed. As shown, the channel 120B leads from an inlet port 120C which is connected to a conduit that leads from the evaporator 102 and in which the pressure sensor 112 is disposed, to a chamber 120D in which a piston 120E is disposed. This piston 120E is arranged to reciprocate within the chamber 120D and displace fluid, which has been permitted to enter thereinto while the piston 120E is in the position illustrated in FIG. 9, as it moves to the position which is shown in FIG. 10. The piston 120E is motivated by linear acting motor or solenoid 120F which is enclosed within a separate compartment and hermetically sealed from the chamber.

The operation of this pump is simple, the solenoid 120F induces the reciprocation of the piston 120E in accordance with input signals which are supplied thereto from the pump controller circuit 208. Further, in this instance, as the pump can be used replace the flow control valve 106, as the piston 120E is spring biased to default to a position wherein the outlet of the chamber 120D is closed when the solenoid 120F is de-energized.

While the head of the piston 120E is shown as being essentially bullet shaped, it is possible to use different shapes which are sculptured in a manner which facilitates smooth displacement of the working fluid, especially at the end of the stroke and just prior to closure of the discharge port of the chamber 120D. Alternatively, the head can be configured with the valve seat portion to produce a squish effect which buffers the final moments of the piston stroke in a manner which reduces impact and the corresponding valve noise.

In addition to controlling the frequency of the reciprocation, it is additionally possible run the pump 120 in a manner wherein the operation is rendered both quiet and efficient. More specifically, it is possible to control the "flight" of the piston through the chamber by determining how the power is applied to the solenoid and/or to control the power application so that what shall be referred to as a "soft landing" of the piston can be achieved at the end of its displacement stroke. That is to say, control the power which drives the piston so that as it approaches the end of its stroke the power is diminished in a manner which so controlled that the piston comes to a halt without noise generating impact and without the wasteful use of electrical power. This sophisticated control of the pump stroke can permit the manner in which working fluid is driven toward the flow control valve 106 in a manner which facilitates improvement of the effect/efficiency of the system as a whole.

Further, if the mass of the amount of fluid which displaced per stroke of the pump is know, the distance to the over which the "slug" of gas will travel, along with a few other details such as the velocity at which the fluid attains, the rate at which it is accelerated, etc., it is possible to control the operation of the pump to attempt to make use of the resonance frequency of the system and to use this phenomenon both upstream as well as downstream of the piston, to induce fluid flow and achieve what shall be referred to as an "inertia ramming" effect which boosts the effect of the pumping.

While the present invention has been described with reference to only a limited number of embodiments, it will be understood that various changes and modifications can be made without departing from the purview of the invention which is limited only by the appended claims. The omission or inclusion of extra elements in the circuit can be envisaged. For example, the flow control valve 106 shown in FIG. 2 for example can be replaced with a pump, as can the flow control device 104. The selectively controllable valve 124 which is used in the embodiment shown in FIG. 7, can be replaced with a pump arrangement if so desired, and so on.

The use of the invention in a small portable "ice bucket" arrangement (merely by way of example) useful for small cooling jobs or even for use at the beach, can be envisaged. In the event that very powerful cooling is not required, then the number of elements which are required can be reduced thus simplifying and lightening the system. Further, in such arrangements, it would be possible to control the amount of cooling and thus regulate the temperature of the contents of the bucket. Therefore, in the case that the "bucket" was being used to cool the flow of a liquid (for example), then the temperature of the liquid could be controlled to a preselected level without the need for extensive amounts of equipment.

What is claimed is:

1. A refrigeration system using working fluid in a closed-loop circuit, comprising:

a condenser;

an evaporator;

a working fluid transfer device downstream of the condenser and fluidly connecting the condenser to the evaporator;

a pressurization assembly providing motive force for moving the working fluid through the closed-loop circuit, the pressurization assembly downstream of the evaporator and fluidly connecting the evaporator to the condenser, the pressurization assembly including a heating chamber for heating the working fluid, a flow-control device for intermittently controlling a flow of the working fluid into the heating chamber, and a pump for receiving the working fluid from the evaporator and providing a predetermined amount of the working fluid at a predetermined pressure through the flow-control device and into the heating chamber; and a controller for selectively controlling the operation of the flow-control device.

2. The refrigeration system according to claim 1, wherein the controller operates the heating chamber, the flow-control device, and the pump to maintain a substantially even pressure differential between the pressurization assembly and the condenser, the evaporator, and the working fluid transfer device.

3. The refrigeration system according to claim 1, further comprising a sensor arrangement connected to the controller, the operation of the pressurization assembly is controlled by the controller in response to input from the sensor arrangement.

4. The refrigeration system according to claim 3, wherein the sensor arrangement includes a first pressure sensor positioned upstream of the valve, and upon the first pressure sensor indicating a pressure below a first selected amount, the controller activating the pump and the flow-control device to introduce the predetermined amount of the working fluid into the heating chamber.

5. The refrigeration system according to claim 4, wherein the flow-control device is a one-way valve.

6. The refrigeration system according to claim 4, wherein the heating chamber includes a heating unit, and upon activation of the flow-control device, the controller increasing heating produced by the heating unit.

7. The refrigeration system according to claim 6, wherein the sensor arrangement includes a second pressure sensor positioned downstream of the valve, and upon the second pressure sensor indicating a pressure above a second selected amount, the controller reducing heating produced by the heating unit.

8. The refrigeration system according to claim 3, wherein the sensor arrangement includes a temperature sensor positioned downstream of the valve.

9. The refrigeration system according to claim 1, wherein the working fluid transfer device is a capillary tube.

10. The refrigeration system according to claim 1, further comprising a dryer downstream of the condenser and fluidly connecting the condenser to the working fluid transfer device.

11. The refrigeration system according to claim 1, further comprising a defrosting heater positioned at a downstream end of the working fluid transfer device.

12. A method of operating a refrigeration system using working fluid in a closed-loop circuit, comprising the steps of:

cooling and condensing the working fluid;

expanding the condensed working fluid;

removing heat with the expanded working fluid; and batching the working fluid used for removing heat to move the working fluid through the closed-loop circuit, wherein the batching includes the separate steps of providing a predetermined amount of the working fluid at a predetermined pressure, intermittently controlling a flow of the working fluid, and heating the provided working fluid.

13. The method of operating a refrigeration system according to claim 12, wherein the batching maintains a substantially even pressure differential between the step of batching and the steps of cooling and condensing the fluid, expanding the fluid, removing the heating with the fluid.

14. The method of operating a refrigeration system according to claim 13, wherein upon a pressure of the working fluid prior to batching drops below a first selected amount, the flow of the working fluid is controlled to provide the predetermined amount of working fluid at the predetermined pressure to be heated.

15. The method of operating a refrigeration system according to claim 14, wherein upon provision of the predetermined amount of working fluid, heating of the working fluid increases.

16. The method of operating a refrigeration system according to claim 15, wherein upon the a pressure of the working fluid being heated rises above a second selected amount, heating of the working fluid decreases.

* * * * *